US008919146B2

(12) United States Patent
Ellis et al.

(10) Patent No.: US 8,919,146 B2
(45) Date of Patent: Dec. 30, 2014

(54) SOFT FREEZE ZONE

(75) Inventors: Adam Ellis, Anderson, SC (US); Timothy Bryan Rackley, Easley, SC (US); Christopher W. Baum, Piedmont, SC (US)

(73) Assignee: Electrolux Home Proucts, Inc., Charlotte, NC (US)

( * ) Notice: Subject to any disclaimer, the term of this patent is extended or adjusted under 35 U.S.C. 154(b) by 174 days.

(21) Appl. No.: 13/540,881

(22) Filed: Jul. 3, 2012

(65) Prior Publication Data

US 2014/0007608 A1 Jan. 9, 2014

(51) Int. Cl.
*F25D 17/08* (2006.01)

(52) U.S. Cl.
USPC ..... 62/405; 62/419; 62/441

(58) Field of Classification Search
CPC ..... F25D 17/05; F25D 17/065; F25D 11/02; F25D 11/022; F25C 5/005; F24F 13/20
USPC ..... 62/405, 344, 441, 259.1, 440, 419; 312/403, 333
See application file for complete search history.

(56) References Cited

U.S. PATENT DOCUMENTS

| | | | | |
|---|---|---|---|---|
| 5,660,777 | A * | 8/1997 | Herrmann et al. | 264/154 |
| 5,735,589 | A * | 4/1998 | Herrmann et al. | 312/408 |
| 6,055,826 | A | 5/2000 | Hiraoka et al. | |
| 6,343,477 | B1 | 2/2002 | Mandel et al. | |
| 6,351,967 | B1 * | 3/2002 | Adachi et al. | 62/441 |
| 6,637,235 | B2 | 10/2003 | Sakamoto et al. | |
| 7,032,407 | B2 | 4/2006 | Chastine | |
| 7,036,334 | B2 | 5/2006 | Ko et al. | |
| 7,082,783 | B2 * | 8/2006 | Uihlein et al. | 62/441 |
| 7,293,846 | B2 * | 11/2007 | Collins et al. | 312/405.1 |
| 7,731,316 | B2 * | 6/2010 | Wing | 312/408 |
| 7,762,102 | B2 | 7/2010 | Hamel et al. | |
| 2006/0152119 | A1 * | 7/2006 | Park | 312/404 |
| 2007/0284985 | A1 * | 12/2007 | Wing | 312/408 |
| 2008/0156006 | A1 * | 7/2008 | Hamel et al. | 62/173 |
| 2009/0113923 | A1 | 5/2009 | Young | |
| 2010/0162747 | A1 * | 7/2010 | Hamel et al. | 62/441 |
| 2011/0095670 | A1 * | 4/2011 | Cho et al. | 312/405.1 |
| 2012/0006047 | A2 * | 1/2012 | Anselmino et al. | 62/344 |
| 2012/0118001 | A1 * | 5/2012 | Mitchell et al. | 62/344 |

FOREIGN PATENT DOCUMENTS

| | | |
|---|---|---|
| EP | 1441190 | 7/2004 |
| EP | 2015009 | 1/2009 |
| KR | 20030038998 | 5/2003 |
| WO | 2011135865 | 11/2011 |

OTHER PUBLICATIONS

International Search Report for PCT/US2013/049056, dated Oct. 11, 2013, 3 pages.

* cited by examiner

*Primary Examiner* — Mohammad M Ali
(74) *Attorney, Agent, or Firm* — Pearne & Gordon LLP

(57) ABSTRACT

A soft freeze assembly is provided within a freezer compartment of a refrigerator assembly. The refrigerator assembly includes a fresh food compartment maintained at a first temperature arranged adjacent the freezer compartment maintained at a second temperature. The soft freeze assembly includes a support structure attached to a wall within the freezer compartment. The soft freeze assembly further includes a storage bin being supported by the support structure and movable with respect to the support structure. The storage bin is structured to allow air exterior from the freezer compartment to enter the storage bin and maintain the storage bin at a third temperature that is colder than the first temperature and warmer than the second temperature.

20 Claims, 5 Drawing Sheets

SOFT FREEZE ZONE

BACKGROUND OF THE INVENTION

1. Field of the Invention

The present invention relates generally to refrigerators, and, more particularly, to refrigerators with a soft freeze assembly bin in a freezer compartment.

2. Description of Related Art

Traditional refrigerators have been designed with a variety of shelves and bins to store food products. For example, it is known to provide shelves and bins within a freezer compartment. Food items, such as ice cream, in a freezer compartment may need to be stored at different temperatures, such as temperatures at or slightly below freezing. Further, food items in the freezer compartment that should be maintained within a certain temperature range may be subject to relatively large temperature fluctuations due to the opening and closing of a freezer door. Therefore, it would be beneficial to provide a storage bin within the freezer compartment that maintains food items at warmer temperatures than the remainder of the freezer compartment and to minimize the effects of temperature fluctuations within the freezer compartment.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect, a soft freeze assembly is within a freezer compartment of a refrigerator assembly. The refrigerator assembly includes a fresh food compartment maintained at a first temperature arranged adjacent the freezer compartment maintained at a second temperature. The soft freeze assembly includes a support structure attached to a wall within the freezer compartment. The soft freeze assembly further includes a storage bin being supported by the support structure and movable with respect to the support structure. The support structure and storage bin are structured to allow air exterior from the freezer compartment to enter the storage bin and maintain the storage bin at a third temperature that is colder than the first temperature and warmer than the second temperature.

In accordance with another aspect, a soft freeze assembly is disposed within a freezer compartment of a refrigerator assembly. The refrigerator assembly includes a fresh food compartment maintained at a first temperature arranged adjacent the freezer compartment maintained at a second temperature. The soft freeze assembly includes a support structure positioned within the freezer compartment and attached to a separating wall that separates the freezer compartment from the fresh food compartment. The support structure includes at least one guide rail movable with respect to the support structure. The support structure further includes a heat transfer opening. The soft freeze assembly further includes a storage bin positioned within an interior of the support structure. The storage bin is attached to the at least one guide rail such that the storage bin is movable between an opened position and a closed position. Air at an exterior of the freezer compartment is configured to pass through the heat transfer opening and maintain the storage bin at a third temperature that is colder than the first temperature and warmer than the second temperature.

In accordance with another aspect, a refrigerator assembly is provided including a freezer compartment and a soft freeze assembly positioned within the freezer compartment. The soft freeze assembly includes a support structure attached to a wall of the freezer compartment and having a bin opening through which access may be had to an interior of the support structure. The support structure further includes a heat transfer opening positioned adjacent the wall of the freezer compartment to which the storage bin is attached. The soft freeze assembly further includes a storage bin removably inserted in the interior of the support structure through the bin opening. Air at an exterior of the freezer compartment passes through the wall and heat transfer opening such that the heat transfer opening is structured to maintain the storage bin at a temperature that is warmer than a temperature of the freezer compartment.

BRIEF DESCRIPTION OF THE DRAWINGS

The foregoing and other aspects will become apparent to those skilled in the art to which the present examples relate upon reading the following description with reference to the accompanying drawings, in which.

DETAILED DESCRIPTION OF THE INVENTION

Figure 1:
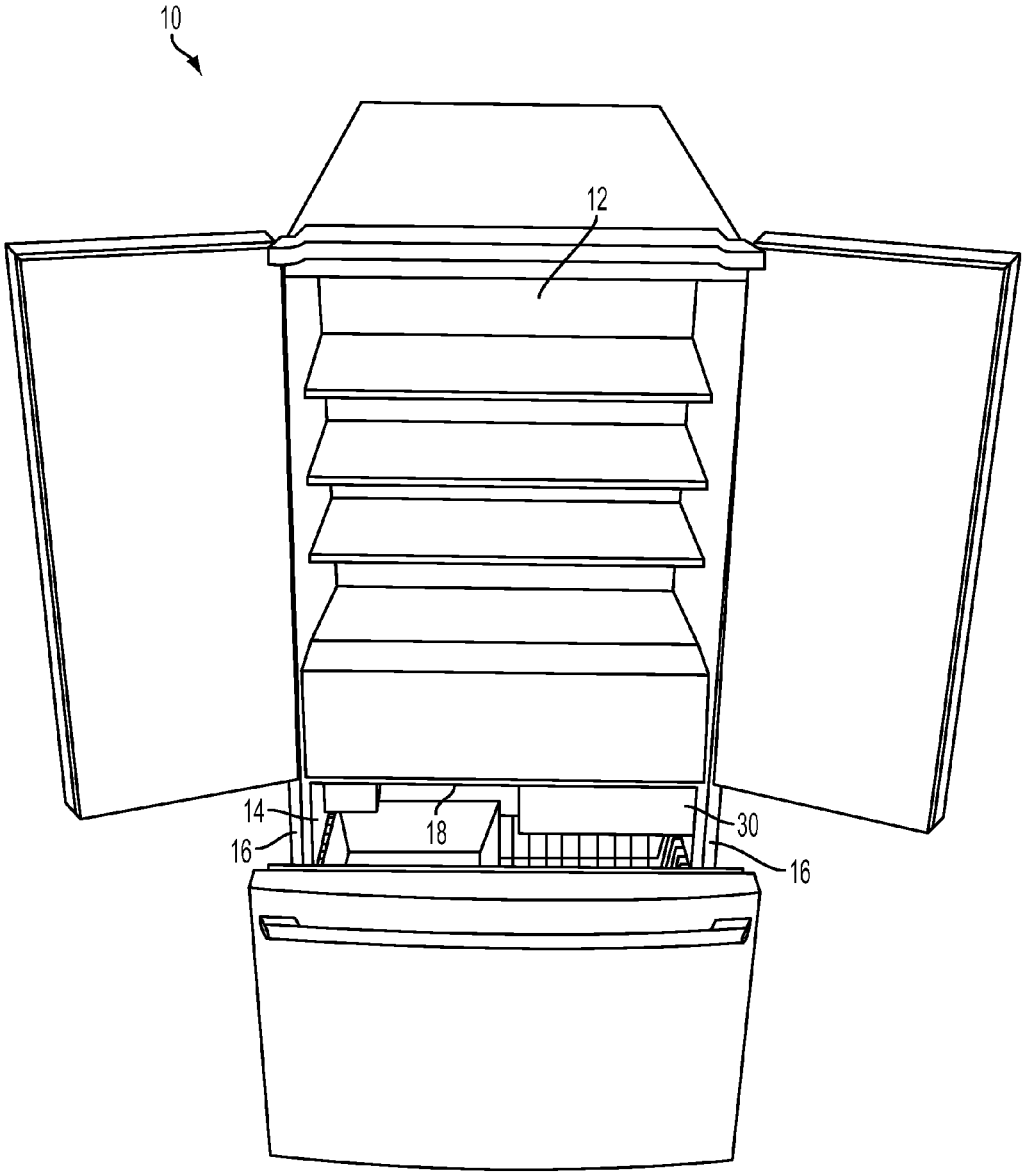
FIG. 1 is a perspective view of an example refrigerator assembly with an example soft freeze assembly positioned in a freezer compartment.

Example embodiments that incorporate one or more aspects are described and illustrated in the drawings. These illustrated examples are not intended to be a limitation on the present examples. For example, one or more aspects can be utilized in other embodiments and even other types of devices. Moreover, certain terminology is used herein for convenience only and is not to be taken as a limitation on the present examples. Still further, in the drawings, the same reference numerals can be employed for designating the same elements.

Referring to the shown example of FIG. 1, an example refrigerator assembly 10 is shown. In short summary, the refrigerator assembly 10 may include one or more compartments, such as a fresh food compartment 12 and a freezer compartment 14. The freezer compartment 14 may include a soft freeze assembly 30. The soft freeze assembly 30 can maintain food items, including frozen deserts such as ice cream, at a temperature that is warmer than a temperature in the freezer compartment 14, but colder than a temperature in the fresh food compartment 12. As such, food items stored in the soft freeze assembly 30 can be maintained at a relatively warmer temperature that reduces the risk of deep freezing, freezer burn, or the like.

The refrigerator assembly 10 shown in FIG. 1 comprises one possible example of a refrigerator assembly 10. For example, the refrigerator assembly shown and described herein can include a French door bottom mount freezer assembly. A French door bottom mount freezer assembly can include a fresh food compartment 12 provided at an upper portion of the refrigerator assembly 10 while the freezer compartment 14 is provided at a bottom portion and underneath the fresh food compartment 12. Of course, in further examples, the refrigerator assembly 10 could be provided with multiple compartments or with compartments located above and/or laterally with respect to one another. The refrigerator assembly 10 could further include a side by side fresh food compartment and freezer compartment. In a further example, the refrigerator assembly 10 could include either of the fresh food compartment 12 or freezer compartment 14 positioned laterally on top of the other of the fresh food compartment 12 or freezer compartment 14. In yet another example, the refrigerator assembly 10 may include only a freezer compartment provided without a fresh food compartment. Accordingly, it is to be appreciated that the refrigerator assembly 10 shown in FIG. 1 comprises only one possible example, as any number of designs and configurations are contemplated.

The refrigerator assembly 10 includes the fresh food compartment 12. The temperature in the fresh food compartment 12 can be maintained at a first temperature. The first temperature can be maintained at a wide range of temperatures, such as at or above 0° C. (32° F.). The fresh food compartment 12 defines a substantially hollow interior portion and may include shelves, drawers, or the like. Food items in the fresh food compartment 12 are maintained at the first temperature. The fresh food compartment 12 can include a pair of doors, such as French doors. It is to be appreciated, however, that the fresh food compartment 12 could include other door assemblies, and is not limited to having the French doors shown in FIG. 1. Rather, in further examples, the fresh food compartment 12 could include a single door, or the like. It is to be appreciated that the fresh food compartment 12 shown in FIG. 1 is somewhat generically depicted, as the fresh food compartment 12 can include any number of shelves, drawers, bins, etc.

The refrigerator assembly 10 further includes the freezer compartment 14. The freezer compartment 14 can be positioned adjacent and underneath the fresh food compartment 12. It is to be appreciated, however, that the freezer compartment 14 could be positioned laterally next to (e.g., side by side) or above (e.g., on top of) the fresh food compartment 12. The freezer compartment 14 can be maintained at a wide range of temperatures, such as at or below 0° C. (32° F.). In one particular example, the freezer compartment 14 is maintained at a temperature range of about −21° C. (−5° F.) to about −23° C. (−10° F.). As such, the freezer compartment 14 can be maintained at a second temperature that is lower than the first temperature of the fresh food compartment 12.

The freezer compartment 14 defines a substantially hollow interior portion and may include shelves, drawers, or the like. The freezer compartment 14 is bounded by side walls 16 and a separating wall 18. The freezer compartment 14 can include three side walls positioned laterally around the freezer compartment 14, with a fourth side (i.e., front facing side) being opened to receive a freezer door. The freezer door is movable between an opened orientation (as shown) or a closed orientation in which the freezer door limits ingress and egress of air into and out of the freezer compartment 14. As such, when the freezer compartment 14 is in the closed orientation, the freezer door blocks the opening of the freezer compartment 14 from the passage of air. The separating wall 18 includes a substantially horizontally oriented wall defining an upper portion of the freezer compartment 14 that separates the freezer compartment 14 from the fresh food compartment 12. The separating wall 18 can be positioned between the freezer compartment 14 and the fresh food compartment 12. In one example, the separating wall 18 can include an upper wall defining an upper surface of the freezer compartment 14.

As is generally known, the side walls 16 and separating wall 18 can each include insulation or the like to reduce heat transfer between an exterior of the refrigerator assembly 10 and the freezer compartment 14. However, warmer air (i.e., air at the first temperature) from the fresh food compartment 12 may nonetheless transfer through the separating wall 18 to the freezer compartment 14 and/or cooler air from the freezer compartment 14 may transfer through the separating wall 18 to the fresh food compartment 12. Accordingly, the temperature at an upper portion of the freezer compartment 14 may be slightly warmer than the remainder of the freezer compartment 14. Similarly, external ambient air may flow from an exterior of the refrigerator assembly 10 and through the side walls 16 and/or cooler air from the freezer compartment 14 may transfer through the side walls 16 to the exterior. As such, the temperature at a side portion of the freezer compartment 14, in particular, an upper side portion, may be slightly warmer than the remainder of the freezer compartment 14.

Figure 2:
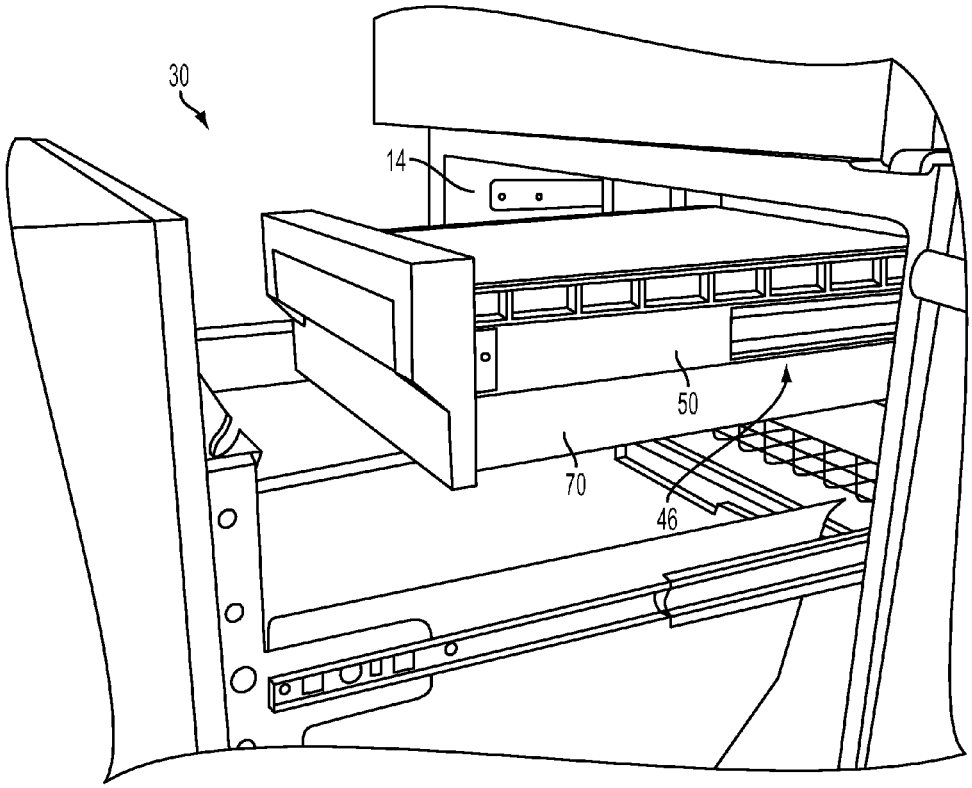
FIG. 2 is an perspective view of an example soft freeze assembly in an opened or withdrawn position.

Referring now to FIG. 2, the refrigerator assembly 10 can further include a soft freeze assembly 30. The soft freeze assembly 30 can be positioned within the freezer compartment 14. In one example, the soft freeze assembly 30 is positioned at an upper corner portion of the freezer compartment 14. A user can selectively move the soft freeze assembly 30 between a closed position (as shown in FIG. 1) and an opened position (as shown in FIG. 2), such that food items can be stored within the soft freeze assembly 30. As will be explained in more detail below, the soft freeze assembly 30 can be maintained at a third temperature that is slightly warmer than the second temperature within the freezer compartment 14.

Figure 3:
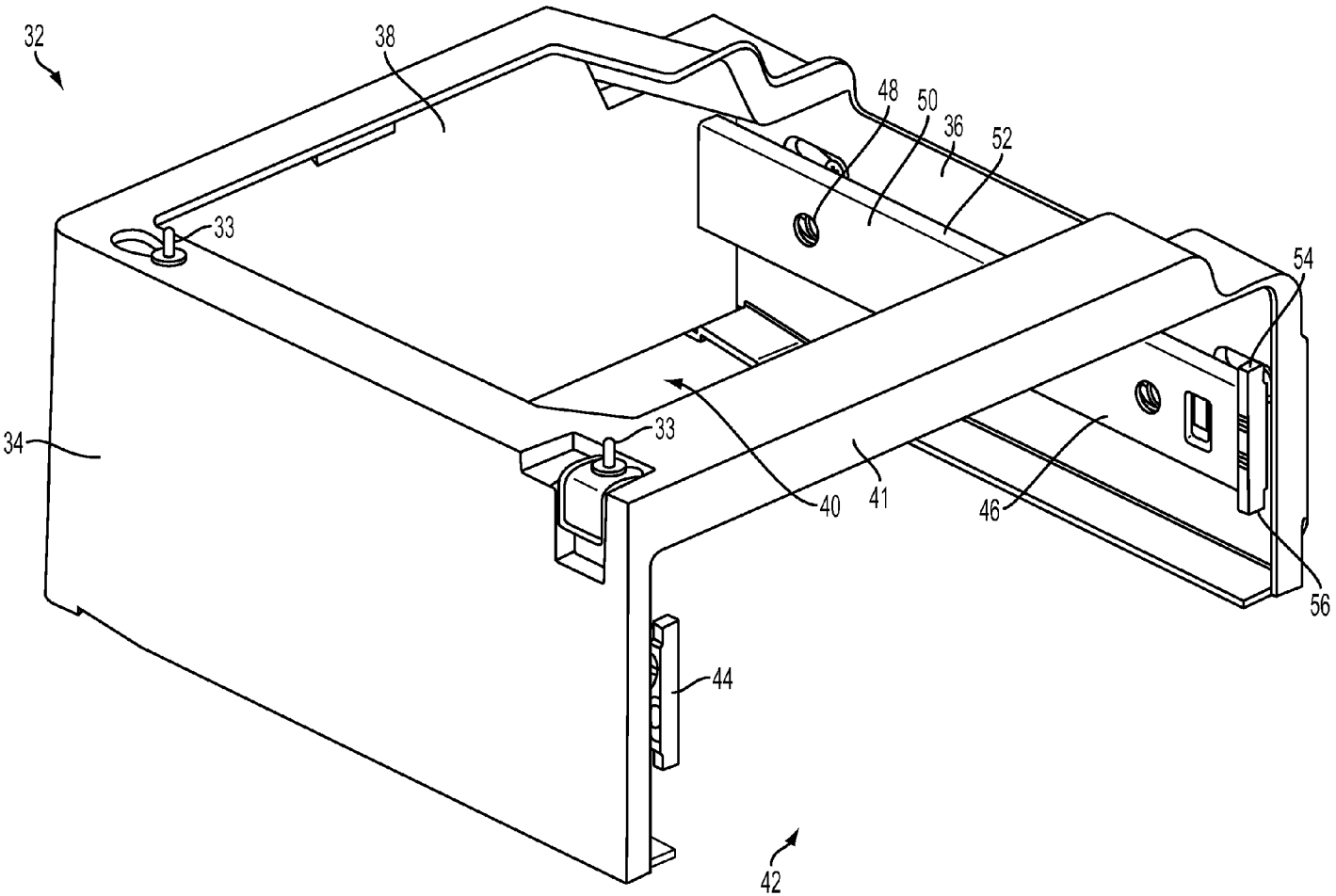
FIG. 3 is a perspective view of an example support structure of the soft freeze assembly.

Referring now to FIG. 3, the soft freeze assembly 30 can include a support structure 32. The support structure 32 can define a substantially hollow support structure into which a storage bin may fit. The support structure 32 can be attached within the freezer compartment 14 in any number of ways. For instance, in one example, the support structure 32 can include one or more attachment structures 33 that function to attach the support structure 32 to the side walls 16 and/or the separating wall 18 of the freezer compartment 14. The attachment structures 33 can comprise any number of devices/structures including, but not limited to, mechanical fasteners (screws, nuts, bolts, etc.), adhesives, snap fit means, or the like. While the attachment structures 33 are only shown on a top surface of the support structure 32, it is to be appreciated that the attachment structures 33 could be placed at any number of locations, such as on side walls, rear walls, etc. of the support structure 32. In further examples, the attachment structures 33 may comprise more than two attachment structures (as shown in FIG. 3), as the attachment structures 33 can relatively easily support the soft freeze assembly 30 and any contents.

The support structure 32 can include one or more lateral walls for supporting the support structure 32. In one example, the support structure 32 includes a first side wall 34, a second side wall 36, and a third side wall 38. The first and second side walls 34, 36 can be positioned on opposing sides of the support structure 32. The third side wall 38 can connect the first side wall 34 to the second side wall 36. In the shown example, the third side wall 38 can form a rear wall of the support structure 32 and can be positioned adjacent the rear wall of the freezer compartment 14. The first, second, and third side walls 34, 36, 38 can each extend in a substantially vertical orientation. Further, one or more of the side walls can include an insulating material. In one example, the third side wall 38 can be insulated, though it is to be appreciated that any of the side walls could be insulated. It is to be understood that the first, second, and third side walls 34, 36, 38 shown in FIG. 3 comprise one possible example of side walls, as a number of sizes, shapes, and orientations are envisioned. Indeed, in further examples, the side walls could include openings through which air convection can occur.

The support structure 32 can further include a heat transfer opening 40. The heat transfer opening 40 is one possible structure that allows for air exterior from the freezer compartment 14 to enter the soft freeze assembly 30 and maintain the third temperature within the soft freeze assembly 30. In one example, the heat transfer opening 40 is disposed towards a top surface of the support structure 32. The heat transfer opening 40 is adjacent the separating wall 18 of the freezer compartment 14. The heat transfer opening 40 can be bounded by the first side wall 34 on one side, the second side wall 36 on an opposing side, and the third side wall 38 on a rear side. In the shown example, the heat transfer opening 40 can be bounded by a support bar 41 positioned at a front surface of the support structure 32 opposite from the third side wall 38. The support bar 41 can extend partially or completely across the heat transfer opening 40 from the first side wall 34 to the second side wall 36.

The heat transfer opening 40 can allow relatively warmer air stored at the first temperature in the fresh food compartment 12 to flow through the separating wall 18 and through the heat transfer opening 40. The heat transfer opening 40 can extend along an upper portion of the second side wall 36, such that the heat transfer opening 40 also is adjacent one of the side walls 16 of the freezer compartment 14. As such, warmer air at an exterior of the freezer compartment 14 may flow through the side wall 16 and into the soft freeze assembly 30 through the heat transfer opening 40.

It is to be appreciated that the heat transfer opening 40 is not limited to the example shown in FIG. 3. Instead, in further examples, the heat transfer opening 40 could be larger or smaller in size. In one possible example, the heat transfer opening 40 could extend a longer distance into the second side wall 36, such that the second side wall 36 has a shorter height than as shown in the example. In a further example, the heat transfer opening 40 could be positioned at either or both of the top surface of the support structure 32 or the side of the support structure 32, such that either or both of the first side wall 34, second side wall 36, and/or third side wall 38 may not be included. In other examples, the heat transfer opening 40 could comprise openings, gaps, slots or the like positioned in one of the first, second, and third side walls 34, 36, 38, such that warmer air can pass through the openings, gaps, slots, or the like and into the soft freeze assembly 30. Accordingly, the heat transfer opening 40 in FIG. 3 comprises merely one possible example of a heat transfer opening, as a number of embodiments are envisioned.

The heat transfer opening 40 can allow for air flow from an exterior location through the heat transfer opening 40. For example, if the heat transfer opening 40 is positioned along the second side wall 36, then air flow can pass through a sidewall of the freezer compartment 14 and through the heat transfer opening 40 in the second side wall 36. In another example, if the heat transfer opening 40 is positioned at the third side wall 38, then the warmer air can flow through a rear wall of the freezer compartment 14 and through the heat transfer opening 40 in the third side wall 38. As such, depending on the location of the heat transfer opening 40, the air flow could pass through some or all of the first, second, and third side walls 34, 36, 38. Along these lines, it is to be appreciated that the heat transfer opening 40 is not limited to receiving warmer air from the exterior of the freezer compartment 14. Rather, in further examples, relatively warmer air from the fresh food compartment 12 can pass through the separating wall 18 and into the freezer compartment 14, whereupon the warmer air can pass through the heat transfer opening 40.

The support structure 32 can further include a bin opening 42. The bin opening 42 can be arranged to extend between the first side wall 34 and second side wall 36 at an opposite side from the third side wall 38. The bin opening 42 can define a substantially hollow opening through which a storage bin can pass through. In one example, the storage bin can pass through the bin opening 42 to access an interior portion of the support structure 32. The bin opening 42 includes a substantially rectangular shape, though other sizes and shapes are envisioned. The bin opening 42 can be sized and shaped to match a cross-sectional shape of the storage bin, such that the storage bin can relatively easily enter and exit the support structure 32.

The support structure 32 can further include one or more guide rails. In one example, the one or more guide rails can include a first guide rail 44 positioned on the first side wall 34 and a second guide rail 46 positioned on the second side wall 36. In particular, the first guide rail 44 is positioned on an interior portion of the first side wall 34 while the second guide rail 46 is positioned on an interior portion of the second side wall 36. The first guide rail 44 and second guide rail 46 can be substantially identical in size, shape, and structure. As will be described in more detail below, the first guide rail 44 and second guide rail 46 can each be attached to the storage bin and can allow the storage bin to move with respect to the support structure 32.

The first guide rail 44 and second guide rail 46 can include any number of structures and embodiments, some of which may be generally known. In the shown example, the first and second guide rails 44, 46 each include a first portion 48. The first portion 48 is somewhat obscured from view in FIG. 3, but can be seen partially through the opening in the second guide rail 46. The first portions 48 can be attached to each of the first side wall 34 and second side wall 36. The first portions 48 can be attached in any number of ways, such as with mechanical fasteners (screws, nuts, bolts, etc.), adhesive means, snap fit means, or the like. Indeed, the first portions 48 could be attached in any number of ways such that the first portions 48 are generally non-movable with respect to each of the first side wall 34 and second side wall 36. The first portions 48 can extend along each of the first side wall 34 and second side wall 36 between a rear portion (adjacent the third side wall 38) and a front portion (adjacent the bin opening 42. The first portions 48 can extend in a substantially horizontal orientation, with the first portion 48 of the first guide rail 44 being generally parallel to the first portion 48 of the second guide rail 46. Of course, it is to be appreciated that the first portion 48 could include a number of different structures and embodiments, such as extending a longer or shorter distance than as shown, or the like.

The first and second guide rails 44, 46 can each include a second portion 50. The second portions 50 can be attached to the first portions 48 such that the second portions 50 are movable with respect to the first portions 48. The second portions 50 can be attached to the first portion 48 in any number of ways to permit the second portion 50 to move with respect to the first portion 48 including, but not limited to, rail locking means, mechanical fasteners, sliding structures, or the like. Indeed, the second portion 50 can be nested into the first portion 48, such that the second portion 50 can slide through the bin opening 42 and out of the support structure 32. It is to be appreciated that the second portion 50 is somewhat generically depicted in FIG. 3, as the second portion 50 can include any number of structures/embodiments that allow for movement with respect to the first portion 48.

The second portion 50 of each of the first and second guide rails 44, 46 can further include a support surface 52. The support surface 52 can define an upper surface of the second portion 50. In one example, the support surface 52 defines a generally horizontally surface positioned at a top of the second portion 50. The support surface 52 can move with the second portion 50 into and out of the support structure 32. As will be described in more detail below, the storage bin can rest on the support surface 52, such that the storage bin can slide into and out of the support structure 32.

The second portion 50 of each of the first and second guide rails 44, 46 can further include one or more engagement portions. In one possible example, the engagement portions can include a first engagement portion 54 and a second engagement portion 56. The first engagement portion 54 and second engagement portion 56 can be positioned on opposing sides of the first and second guide rails 44, 46. In particular, the first engagement portion 54 can be positioned at a top of the first and second guide rails 44, 46 adjacent the support surface 52 while the second engagement portion 56 can be positioned at a bottom of the first and second guide rails 44, 46. The first and second engagement portions 54, 56 can each project outwardly in a direction away from the first and second guide rails 44, 46. In one example, the first and second engagement portions 54, 56 can project in a direction that is substantially perpendicular to a longitudinal direction along which the first and second guide rails 44, 46 extend. The first and second engagement portions 54, 56 can be integrally formed with the second portion 50 or, in the alternative, can be attached separately. Accordingly, as the second portion 50 of the first and second guide rails 44, 46 moves between an opened/withdrawn position (shown in FIG. 2) and a closed position (shown in FIG. 1), the first and second engagement portions 54, 56 can move along with the second portion 50.

It is to be appreciated that the support structure 32 shown in FIG. 3 comprises merely one possible example of a support structure that can be used for attaching a storage bin within the freezer compartment 14. Indeed, in further examples, the support structure 32 need not include the first side wall 34, second side wall 36, and/or third side wall 38. Instead, the support structure 32 could include fewer side walls than as shown. Even further, the support structure 32 may not include any side walls, as the support structure 32 could instead include one or more attachment structures, such as rails, brackets, or the like, that project from the separating wall 18 and/or the side walls 16. In such an example, a storage bin could be attached directly to the attachment structures (rails, brackets, etc.). In yet another example, the support structure 32 could include slots, grooves, or the like formed in one or more of the side walls 16 or separating wall 18 such that the slots, grooves, or the like can receive a storage bin. Even further, the support structure 32 may include the guide rails 44, 46, without any side walls 34, 36, 38, with the guide rails 44, 46 being attached directly to walls 16, 18 of the freezer compartment 14. As such, it is to be appreciated that the support structure 32 can include any number of designs and configurations that function to attach a storage bin, or the like within the freezer compartment 14.

Figure 4:
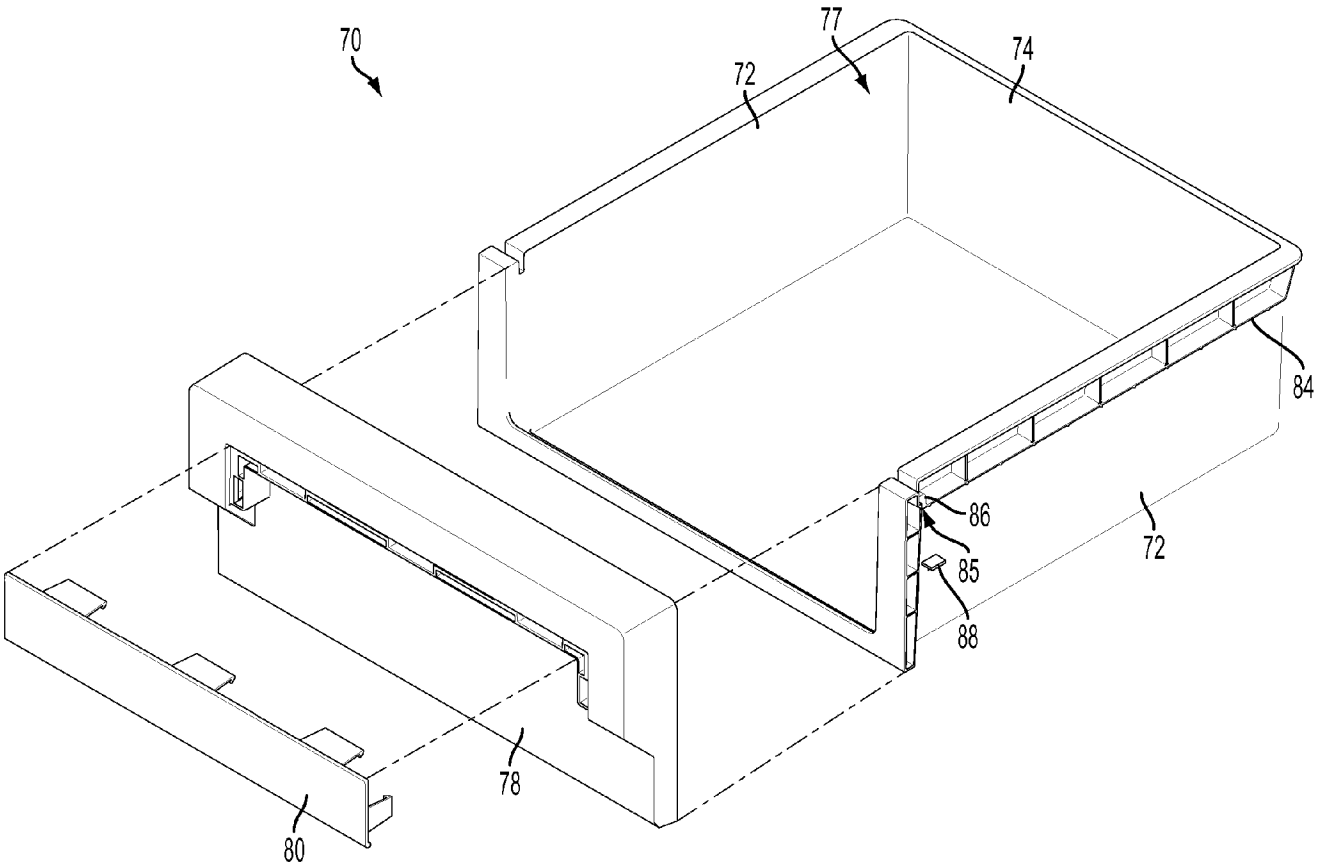
FIG. 4 is a perspective view of an example storage bin of the soft freeze assembly.

Referring now to FIG. 4, the soft freeze assembly 30 can further include a storage bin 70. The storage bin 70 is depicted in a partially exploded state in FIG. 4 for illustrative purposes (e.g., front wall and handle portion 80 being detached from the storage bin 70). However, it is to be appreciated that in operation, the storage bin 70 is in a fully assembled state (as shown in FIGS. 1 and 2).

The storage bin 70 can be a bucket shaped structure that is sized to receive and hold objects, including frozen food items such as ice cream, or the like. The storage bin 70 can be bounded by vertical walls and a horizontal bottom wall. Together, the walls define an interior portion of the storage bin 70. In one example, the vertical walls can include a pair of side walls 72 and a rear wall 74. The side walls 72 can be arranged at opposing sides of the storage bin 70 while the rear wall 74 can be positioned at a rear of the storage bin 70 and can be attached at opposing ends to the side walls 72.

The side walls 72 and rear wall 74 can define an opening 77 at a top portion of the storage bin 70, such that objects can be inserted into the interior portion of the storage bin 70 through the opening 77. The storage bin 70 can further include a front wall 78 having a handle portion 80. As is generally known, a user can grasp the handle portion 80 to withdraw the storage bin 70 from the support structure 32. When the soft freeze assembly 30 is in the closed position (shown in FIG. 1), the opening 77 can be adjacent the heat transfer opening 40. As such, the opening 77 is in fluid communication with the heat transfer opening 40. The opening 77 is therefore another possible structure that allows for air exterior from the freezer compartment 14 to enter the soft freeze assembly 30 and maintain the third temperature within the soft freeze assembly 30.

It is to be appreciated that the storage bin 70 shown in FIG. 4 comprises only one possible shape. However, the storage bin 70 could include any number of sizes, shapes, and orientations. For example, the storage bin 70 could be larger or smaller. Similarly, the walls of the storage bin 70 could be integrally formed as one piece or, in the alternative, could be separately formed and attached together. Even further, the front wall 78 is not limited to having the handle portion 80, and in further examples, could be similar or identical in structure to the side walls 72 or rear wall 74.

The side walls 72 can include one or more stop structures for attaching the storage bin 70 to the first guide rail 44 and second guide rail 46. The stop structures can be positioned on exterior portions of each of the side walls 72. As will be described in more detail below, the stop structures can engage the first and second guide rails 44, 46 such that the storage bin 70 can move into and out of the support structure 32. In one possible example, the one or more stop structures can include a first stop structure 84, a second stop structure 86, and a third stop structure 88.

The one or more stop structures can include the first stop structure 84. The first stop structure 84 can be positioned on exterior surfaces of each of the side walls 72. The first stop structures 84 can be substantially identical to each other on the side walls 72. The first stop structure 84 can define an outward protrusion that extends outwardly from the side walls 72. In one example, the first stop structure 84 extends in a direction that is substantially perpendicular with respect to a plane formed by the side walls 72. The first stop structure 84 can extend from a first end to an opposing second end of the side walls 72, such as from the front wall 78 to the rear wall 74. In further examples, however, it is to be appreciated that the first stop structure 84 could extend a shorter distance than as shown in the example. The first stop structure 84 defines a ledge, outcropping, shelf, or the like, such that the first stop structure 84 can rest on a corresponding structure. In one example, the first stop structure 84 can be supported by the support surface 52, such that the first stop structure 84 rests on the support surface 52. Accordingly, the storage bin 70 can be supported by the first stop structure 84 contacting the support surface 52.

The one or more stop structures can also include the second stop structure 86. The second stop structure 86 can be positioned on exterior surfaces of the side walls 72. The second stop structures 86 can be substantially identical to each other on the side walls 72. As with the first stop structure 84, the second stop structure 86 can define an outward protrusion that extends outwardly from the side walls 72. The second stop structure 86 can project towards an upper surface of the side wall 72 in a direction away from the first stop structure 84. The second stop structure 86 can further define a recess 85 positioned adjacent the front wall 78. The recess 85 can be sized and shaped to substantially match a size and shape of the first engagement portion 54. Indeed, in one example, the recess 85 can have dimensions that are slightly larger than dimensions of the first engagement portion 54. As such, the first engagement portion 54 can be positioned within the recess 85 of the second stop structure 86, allowing for the storage bin 70 to move with respect to the support structure 32.

It is to be appreciated that the second stop structure 86 shown in FIG. 4 comprises only one possible example of a second stop structure 86. For instance, the second stop structure 86 is shown positioned adjacent the front wall 78. However, in further examples, the second stop structure 86 could be positioned at a variety of locations along the length of the first stop structure 84. Similarly, the second stop structure 86 is not limited to the size and shape that is shown in FIG. 4. Rather, the second stop structure 86 could be larger or smaller in size, or could take on nearly any size that allows for nesting with the first engagement portion 54.

The one or more stop structures can also include the third stop structure 88. The third stop structure 88 can be positioned on exterior surfaces of each of the side walls 72. The third stop structures 88 can be substantially identical to each other on the side walls 72. As with the first and second stop structures 84, 86, the third stop structure 88 can define an outward protrusion that extends outwardly from the side walls 72. In one example, the third stop structure 88 can be positioned near the front wall 78, though the third stop structure 88 could be positioned closer to or farther from the front wall 78. The third stop structure 88 can be spaced a distance from both the first and second stop structures 84, 86, such that a gap, slot, or the like extends between the third stop structure 88 on one side, and the first and second stop structures 84, 86 on an opposing second side. The third stop structure 88 can define a ledge, outcropping, shelf, or the like that is substantially parallel to the first stop structure 84. As such, the third stop structure 88 can engage and/or contact the first and second guide rails 44, 46 at a lower portion while the first stop structure 84 and second stop structure 86 can engage and/or contact the first and second guide rails 44, 46 at an upper portion (e.g., at the support surface 52). It is to be appreciated that the third stop structure 88 shown in FIG. 4 comprises merely one possible structure of the third stop structure, as a number of embodiments are envisioned. For example, the third stop structure 88 could extend a longer or shorter distance along the side walls 72 between the front wall 78 and the rear wall 74. Similarly, the third stop structure 88 could extend outwardly from the side walls 72 a longer or shorter distance than as shown.

Figure 5:
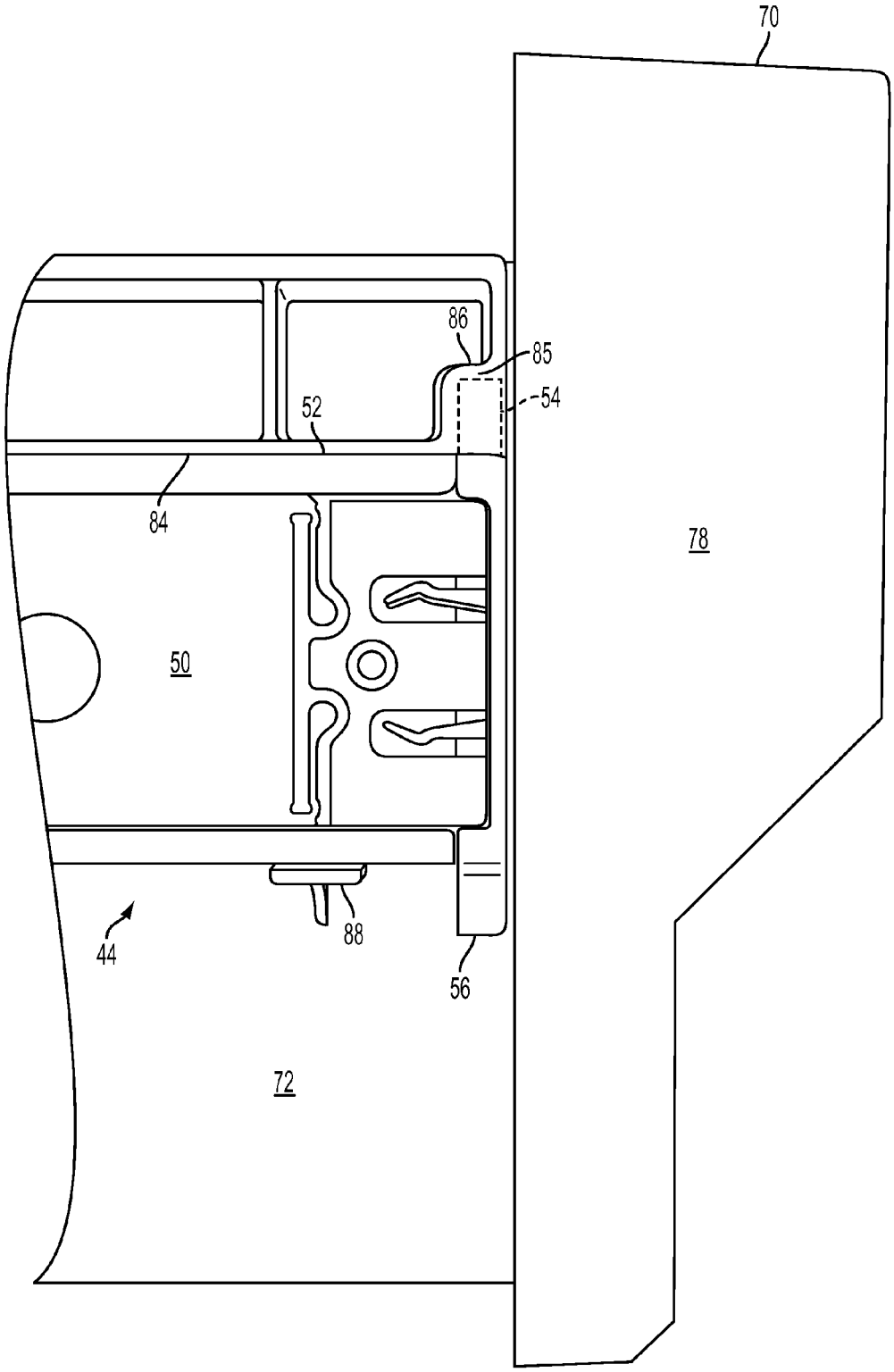
FIG. 5 is a perspective view of the storage bin in attachment to the support structure.

Referring to FIG. 5, the attachment of the storage bin 70 with respect to the support structure 32 can now be described. The storage bin 70 can be attached at the side walls 72 to each of the first guide rail 44 and the second guide rail 46. FIG. 5 depicts a side view of the first guide rail 44 in attachment with the storage bin 70. However, it is to be appreciated that the opposing side of the storage bin 70 can be attached to the second guide rail 46 in substantially the same manner as shown in FIG. 5 and described herein.

The first guide rail 44 can be positioned adjacent the side wall 72, such that the first guide rail 44 extends in a substantially parallel direction with respect to the side wall 72. The first guide rail includes the first engagement portion 54 (shown in phantom in FIG. 5 as the first engagement portion 54 is hidden by the second stop structure 86 and is not visible) and the second engagement portion 56. The first engagement portion 54 can extend into the recess 85 of the second stop structure 86, such that the first engagement portion 54 and second stop structure 86 can move together in unison. Indeed, the second stop structure 86 can include a cover, shield, or the like, such that the first engagement portion 54 is not inadvertently removed from the second stop structure 86. Accordingly, the second stop structure 86 can limit both forward and backward movement, and lateral movement of the first engagement portion 54.

As the first engagement portion 54 is nested in the first stop structure 84, the second engagement portion 56 can contact the front wall 78. As shown, the second engagement portion 56 can engage and contact a rear surface of the front wall 78. As such, the front wall 78 can limit forward movement (i.e., towards the front wall 78) of the first guide rail 44 with respect to the storage bin 70.

The first guide rail 44 is positioned between the first stop structure 84 on one side and the third stop structure 88 on an opposing side. Indeed, the first stop structure 84 can contact and rest on the support surface 52, such that the engagement between the first stop structure 84 and support surface 52 generally supports the storage bin 70 with respect to the first guide rail 44. Opposite from the first stop structure 84, the third stop structure 88 can contact a lower surface of the first guide rail 44. The third stop structure 88 is spaced a distance from the first stop structure 84 that substantially matches a height of the first guide rail 44. As such, the first guide rail 44 is in relatively close contact with each of the first stop structure 84 and third stop structure 88. The third stop structure 88 can limit upward movement of the storage bin 70 with respect to the first guide rail 44. In the shown example, if the storage bin 70 is shifted upwardly with respect to the first guide rail 44, the first guide rail 44 can contact and engage the third stop structure 88 to maintain the attachment of the storage bin 70 to the first and second guide rails 44, 46.

The operation of the soft freeze assembly 30 can now be described. Food items can be initially stored in the soft freeze assembly 30. In particular, a user can place the food items in the storage bin 70 and move the soft freeze assembly 30 into a closed position (shown in FIG. 1). With the soft freeze assembly 30 in the closed position, the soft freeze assembly 30 can receive relatively warmer air from either or both of the fresh food compartment 12 or an exterior of the refrigerator assembly 10. In particular, relatively warmer air stored at the first temperature in the fresh food compartment 12 can naturally pass through the separating wall 18 and into the freezer compartment 14. This relatively warmer air can pass through the heat transfer opening 40 of the support structure 32 and through the opening 77 in the storage bin 70. As such, the contents of the storage bin 70, such as ice cream, frozen yogurt, etc., can be maintained at a slightly warmer temperature (third temperature) than the temperature (second temperature) in the freezer compartment 14. In one example, this temperature variance can occur naturally and without the use of heating devices, or the like. Accordingly, food items stored in the soft freeze assembly 30 are less likely to exhibit freezer burn, deep freezing, etc.

The third temperature in the soft freeze assembly 30 can, in one example, be in the range of about −14° C. (6° F.) to about −12° C. (10 F.). The second temperature in the freezer compartment 14 can, in one example, be in the range of about −21° C. (−5° F.) to about −23° C. (−10° F.). As such, the soft freeze assembly 30 can be maintained at the third temperature that is warmer than the second temperature in the freezer compartment 14. Moreover, when the soft freeze assembly 30 is in the closed position, the contents in the soft freeze assembly 30 can be somewhat shielded from temperature fluctuations caused by opening and closing of the freezer compartment. As such, the third temperature in the soft freeze assembly 30 can remain relatively constant even during the opening and closing of the freezer compartment.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A soft freeze assembly disposed within a freezer compartment of a refrigerator assembly, the refrigerator assembly including a fresh food compartment maintained at a first temperature arranged adjacent the freezer compartment maintained at a second temperature, the soft freeze assembly including:

a support structure attached to a wall within the freezer compartment;

a storage bin supported by the support structure and movable with respect to the support structure, the support structure and storage bin being structured to allow air exterior from the freezer compartment to enter the storage bin and maintain the storage bin at a third temperature that is colder than the first temperature and warmer than the second temperature when the freezer compartment is in a closed orientation, and a handle portion of the storage bin, wherein the handle portion of the storage bin can be accessed only when a door of the freezer compartment is in an open orientation.

2. The soft freeze assembly of claim 1, wherein the support structure includes a first guide rail disposed on a first side wall of the support structure and a second guide rail disposed on a second side wall of the support structure, each of the guide rails including at least one engagement portion.

3. The soft freeze assembly of claim 2, wherein the at least one engagement portion includes a first engagement portion and a second engagement portion, each of the engagement portions projecting outwardly in a direction away from the guide rails.

4. The soft freeze assembly of claim 3, wherein the storage bin includes at least one stop structure for engaging the engagement portions, the at least one stop structure being configured to attach the storage bin to the support structure.

5. The soft freeze assembly of claim 4, wherein the at least one stop structure includes a first stop structure positioned on opposing side walls of the storage bin and extending outwardly from each of the opposing side walls, the first stop structure being configured to rest on an upper surface of one of the guide rails such that the guide rails support the first stop structure.

6. The soft freeze assembly of claim 1, wherein the support structure includes a heat transfer opening positioned adjacent the wall to which the support structure is attached.

7. The soft freeze assembly of claim 6, wherein the fresh food compartment is arranged above the freezer compartment such that the wall includes a separating wall that is positioned at an upper portion of the freezer compartment, further wherein the heat transfer opening defines a passage through which air at the first temperature in the fresh food compartment is configured to flow through and enter the soft freeze assembly.

8. A soft freeze assembly disposed within a freezer compartment of a refrigerator assembly, the refrigerator assembly including a fresh food compartment maintained at a first temperature arranged adjacent the freezer compartment maintained at a second temperature, the soft freeze assembly including:

a support structure attached to a wall within the freezer compartment; and a storage bin supported by the support structure and movable with respect to the support structure, the support structure and storage bin being structured to allow air exterior from the freezer compartment to enter the storage bin and maintain the storage bin at a third temperature that is colder than the first temperature and warmer than the second temperature when the freezer compartment is in a closed orientation, wherein the support structure includes a first guide rail disposed on a first side wall of the support structure and a second guide rail disposed on a second side wall of the support structure, each of the guide rails including at least one engagement portion comprising, said at least one engagement portion including a first engagement portion and a second engagement portion, each of the engagement portions projecting outwardly in a direction away from the guide rails, wherein the storage bin includes at least one stop structure for engaging the engagement portions, the at least one stop structure being configured to attach the storage bin to the support structure, and wherein the at least one stop structure includes a first stop structure positioned on opposing side walls of the storage bin and extending outwardly from each of the opposing side walls and a second stop structure positioned on opposing side walls of the storage bin, said first stop structure being configured to rest on an upper surface of one of the guide rails such that the guide rails support the first stop structure and said second stop structure defining a recess having a shape that substantially matches a shape of the first engagement portion such that the first engagement portion is received by the second stop structure.

9. The soft freeze assembly of claim 8, wherein the at least one stop structure includes a third stop structure positioned on opposing side walls of the storage bin, the third stop structure extending outwardly from each of the opposing side walls, wherein the first stop structure and the third stop structure define a space extending therebetween such that one of the guide rails is configured to extend between the first stop structure and the third stop structure when the storage bin is attached to the support structure.

10. A soft freeze assembly disposed within a freezer compartment of a refrigerator assembly, the refrigerator assembly including a fresh food compartment maintained at a first temperature arranged adjacent the freezer compartment maintained at a second temperature, the soft freeze assembly including:

a support structure positioned within the freezer compartment and attached to a separating wall that separates the freezer compartment from the fresh food compartment, the support structure including at least one guide rail movable with respect to the support structure, the support structure further including a heat transfer opening;

a storage bin positioned within an interior of the support structure, the storage bin being attached to the at least one guide rail such that the storage bin is movable between an opened position and a closed position, wherein the heat transfer opening is configured to allow air at an exterior of the freezer compartment to pass through the heat transfer opening and maintain the storage bin at a third temperature that is colder than the first temperature and warmer than the second temperature; and a handle portion of the storage bin, wherein the handle portion of the storage bin can be accessed only when a door of the freezer compartment is in an open orientation.

11. The soft freeze assembly of claim 10, wherein each of the at least one guide rail includes a first engagement portion and a second engagement portion, the engagement portions being disposed on opposing sides of the guide rails and projecting outwardly in a direction away from the guide rails.

12. The soft freeze assembly of claim 11, wherein the storage bin includes at least one stop structure for engaging the engagement portions, the at least one stop structure being configured to attach the storage bin to the support structure.

13. The soft freeze assembly of claim 12, wherein the at least one stop structure includes a first stop structure positioned on opposing side walls of the storage bin, the first stop structure extending outwardly from each of the opposing side walls, wherein the first stop structure is configured to rest on an upper surface of one of the guide rails such that the guide rails support the first stop structure.

14. The soft freeze assembly of claim 10, wherein the heat transfer opening is positioned at an upper surface of the support structure and adjacent the separating wall of the freezer compartment, the heat transfer opening defining a passage through which air maintained at the first temperature in the fresh food compartment is configured to flow through and enter the soft freeze assembly.

15. A refrigerator assembly, including:

a freezer compartment; and a soft freeze assembly positioned within the freezer compartment, the soft freeze assembly including:

a support structure attached to a wall of the freezer compartment, the support structure having a bin opening providing access to an interior of the support structure, the support structure further including a heat transfer opening positioned adjacent the wall of the freezer compartment to which the storage bin is attached;

a storage bin removably inserted in the interior of the support structure through the bin opening, wherein the heat transfer opening is configured to allow air at an exterior of the freezer compartment to pass through the wall and heat transfer opening such that the heat transfer opening is structured to maintain the storage bin at a temperature that is warmer than a temperature of the freezer compartment; and a handle portion of the storage bin, wherein the handle portion of the storage bin can be accessed only when a door of the freezer compartment is in an open orientation.

16. The soft freeze assembly of claim 15, wherein the wall of the freezer compartment includes a separating wall that separates the freezer compartment from a fresh food compartment, the heat transfer opening being positioned at an upper surface of the support structure adjacent the separating wall.

17. The soft freeze assembly of claim 16, wherein the storage bin includes an opening at an upper portion of the storage bin, the opening being in fluid communication with the heat transfer opening when the storage bin is inserted into the support structure.

18. The soft freeze assembly of claim 15, wherein the refrigerator assembly includes a fresh food compartment.

19. The soft freeze assembly of claim 18, wherein the temperature in the storage bin is in a range of about −14° C. to about −12° C.

20. The soft freeze assembly of claim 19, wherein the temperature in the freezer compartment is in a range of about −21° C. to about −23° C.

* * * * *